US007754142B2

(12) United States Patent
Liang

(10) Patent No.: US 7,754,142 B2
(45) Date of Patent: Jul. 13, 2010

(54) ACID RESISTANT AUSTENITIC ALLOY FOR VALVE SEAT INSERTS

(75) Inventor: Xuecheng Liang, Green Bay, WI (US)

(73) Assignee: Winsert, Inc., Marinette, WI (US)

( * ) Notice: Subject to any disclaimer, the term of this patent is extended or adjusted under 35 U.S.C. 154(b) by 0 days.

(21) Appl. No.: 11/735,286

(22) Filed: Apr. 13, 2007

(65) Prior Publication Data

US 2008/0253918 A1 Oct. 16, 2008

(51) Int. Cl.

| | |
|---|---|
| ***C22C 38/36*** | (2006.01) |
| ***C22C 38/42*** | (2006.01) |
| ***C22C 38/44*** | (2006.01) |
| ***C22C 38/00*** | (2006.01) |
| ***C22C 38/48*** | (2006.01) |
| ***C22C 38/50*** | (2006.01) |
| ***C22C 38/40*** | (2006.01) |
| ***C22C 38/12*** | (2006.01) |
| ***C22C 38/18*** | (2006.01) |
| ***C21D 5/00*** | (2006.01) |

(52) U.S. Cl. ..... 420/12; 420/49; 420/52; 420/53; 420/54; 420/55; 420/96; 420/97; 148/321; 148/325

(58) Field of Classification Search ..... 420/12, 420/34, 43, 49, 52–55, 94, 96, 97; 148/321, 148/325

See application file for complete search history.

(56) References Cited

U.S. PATENT DOCUMENTS

| | | | | |
|---|---|---|---|---|
| 1,556,776 | A | 10/1925 | Flintermann | |
| 2,225,730 | A * | 12/1940 | Armstrong | 148/326 |
| 3,257,178 | A | 6/1966 | Severns, Jr. et al. | |
| 3,410,732 | A | 11/1968 | Smith | |
| 4,075,999 | A | 2/1978 | Danis | |
| 4,122,817 | A | 10/1978 | Matlock | |
| 4,191,562 | A | 3/1980 | Silence | |
| 4,224,060 | A | 9/1980 | de Souza et al. | |
| 4,228,223 | A | 10/1980 | Knotek et al. | |
| 4,292,074 | A | 9/1981 | Komiyama et al. | |
| 4,363,660 | A | 12/1982 | Wakita et al. | |
| 4,430,297 | A | 2/1984 | Crook | |
| 4,724,000 | A | 2/1988 | Larson et al. | |
| 4,810,464 | A | 3/1989 | Szereto et al. | |
| 4,844,024 | A | 7/1989 | Fujiki et al. | |
| 4,929,419 | A | 5/1990 | Wegman et al. | |
| 5,116,571 | A | 5/1992 | Abe et al. | |
| 5,147,475 | A | 9/1992 | Holmberg | |
| 5,194,221 | A | 3/1993 | Culling | |
| 5,246,661 | A | 9/1993 | Culling | |
| 5,292,382 | A | 3/1994 | Longo | |
| 5,360,592 | A | 11/1994 | Culling | |
| 5,458,703 | A | 10/1995 | Nakai | |
| 5,674,449 | A | 10/1997 | Liang et al. | |
| 6,200,688 | B1 | 3/2001 | Liang et al. | |
| 6,436,338 | B1 | 8/2002 | Qiao | |
| 6,485,678 | B1 | 11/2002 | Liang et al. | |
| 6,702,905 | B1 | 3/2004 | Qiao et al. | |
| 6,866,816 | B2 | 3/2005 | Liang et al. | |
| 6,916,444 | B1 | 7/2005 | Liang | |
| 2005/0236072 | A1 * | 10/2005 | Takayama | 148/334 |

FOREIGN PATENT DOCUMENTS

| | | | |
|---|---|---|---|
| DE | 2 929 811 | | 2/1980 |
| DE | 10 305 568 | | 8/2003 |
| EP | 0 264 528 | | 4/1988 |
| EP | 0 430 241 | A1 | 6/1991 |
| EP | 1 391 529 | A1 | 2/2004 |
| EP | 1 614 762 | A2 | 1/2006 |
| EP | 1 775 351 | A1 | 4/2007 |
| FR | 2 835 850 | | 8/2003 |
| GB | 553 397 | | 5/1943 |
| GB | 741 053 | | 11/1955 |
| GB | 2 301 116 | A | 11/1996 |
| JP | 48-102717 | A | 12/1973 |
| JP | 57-130714 | | 8/1982 |
| JP | 60-258449 | | 12/1985 |
| JP | 10-68041 | | 3/1998 |
| JP | 11-61320 | | 3/1999 |
| JP | 2001-40458 | | 2/2001 |

OTHER PUBLICATIONS

"Metallurgy and Properties of Wrought Stainless Steels," ASM Specialty Handbook , Stainless Steels, pp. 13-65 (1994).

Strong, G., et al., "A review of valve seat insert material properties required for success." Retrieved from STN Database Accession No. XP002183697, Proceedings of the International Symposium on Valvetrain System Design and Materials, Dearborn, MI USA, pp. 121-127 (Apr. 14, 1997).

* cited by examiner

*Primary Examiner*—Roy King
*Assistant Examiner*—Caitlin Fogarty
(74) *Attorney, Agent, or Firm*—Brinks Hofer Gilson & Lione; Steven P. Shurtz

(57) ABSTRACT

A high-carbon austenitic iron-base alloy with good corrosion and wear resistance, particularly useful for valve seat insert applications when corrosion resistance is required, comprises about 1.8-3.5 wt % carbon, about 12-24 wt % chromium, about 0.5-4 wt % silicon, about 12-25 wt % nickel, about 2-12 wt % molybdenum and tungsten combined, about 0.05-4 wt % niobium and vanadium combined, about 0-1 wt % titanium, about 0.01-0.2 wt % aluminum, about 0.05-3 wt % copper, and less than 1.5 wt % manganese, with the balance being iron and a small amount of impurities.

20 Claims, No Drawings

ACID RESISTANT AUSTENITIC ALLOY FOR VALVE SEAT INSERTS

BACKGROUND OF THE INVENTION

This invention relates to an acid-corrosion resistant and wear resistant austenitic iron-base alloys that possess excellent resistance to sulfuric acid and are superior to high-speed steels and high-chromium, high-carbon type iron base alloys for many applications where both sulfuric acid corrosion and wear occur simultaneously. This invention further relates to such corrosion resistant alloys useful for making valve seat inserts used in internal combustion engines with an exhaust gas recirculation (EGR) system.

Internal combustion engines equipped with EGR systems require intake valve seat insert materials with excellent corrosion resistance due to the formation of sulfuric acid in the intake insert area when sulfur oxide that comes from diesel fuel after combustion meets with moisture from incoming air. Sulfur content in diesel fuel seems relatively low; however, the concentration of sulfuric acid will likely increase with engine running time as combustion deposits from exhaust gas accumulated around the inner wall area of an intake insert will absorb more sulfuric acid. Severe corrosion can occur on intake valve seat inserts made from M2 tool steel once the amount of high-concentration acid is enough. Cobalt-base alloy Stellite® 3 (Stellite is a Registered Trademark of Deloro Stellite Holdings Company) possesses excellent corrosion resistance and good wear resistance under diesel engine intake valve working conditions and therefore this cobalt alloy is normally the choice as the intake valve insert material to ensure the valve train service life in EGR device equipped diesel engines.

Traditionally, modified M2 tool steel and Silichrome XB are two common material choices for making diesel engine intake valve seat inserts. In broad ranges, modified M2 tool steel comprises 1.2-1.5 wt % carbon, 0.3-0.5 wt % silicon, 0.3-0.6 wt % manganese, 6.0-7.0 wt % molybdenum, 3.5-4.3 wt % chromium, 5.0-6.0 wt % tungsten, up to 1.0 wt % nickel, and the balance being iron. It is believed that Modified Silichrome XB contains 1.3-1.8 wt % carbon, 1.9-2.6 wt % silicon, 0.2-0.6 wt % manganese, 19.0-21.0 wt % chromium, 1.0-1.6 wt % nickel, and the balance being iron. Another common iron-base alloy for intake valve seat inserts contains 1.8-2.3 wt % carbon, 1.8-2.1 wt % silicon, 0.2-0.6 wt % manganese, 2.0-2.5 wt % molybdenum, 33.0-35.0 wt % chromium, up to 1.0 wt % nickel, and the balance being substantially iron. There are also several high chromium-type iron-base alloys available for making intake valve seat inserts.

U.S. Pat. No. 6,916,444 discloses an iron-base alloy containing a large amount of residual austenite for intake valve seat insert material. U.S. Pat. No. 6,436,338 discloses a corrosion resistant iron-base alloy for diesel engine valve seat insert applications. U.S. Pat. No. 6,866,816 discloses an austenitic type iron-base alloy with good corrosion resistance. However, more severe corrosion conditions in some engines with high sulfur fuel and high humidity demand materials with corrosion resistance much better than the above identified iron-base alloys.

High-carbon and high-chromium type nickel-base alloys normally do not exhibit good wear resistance under intake valve seat insert working conditions due to a lack of combustion deposits and an insufficient amount of metal oxides often found in exhaust valve applications, which help protect exhaust valve seat inserts from direct metal-to-metal wear. Eatonite® 2 (Eatonite is a Registered Trademark of Eaton Corporation) is one example of the nickel-base alloys used for making exhaust valve seat inserts, which is believed to contain 2.0-2.8 wt % carbon, up to 1.0 wt % silicon, 27.0-31.0 wt % chromium, 14.0-16.0 wt % tungsten, up to 8.0 wt % iron, and the balance being essentially nickel. Several similar nickel-base alloys with added iron and/or cobalt are also available for exhaust valve seat inserts. U.S. Pat. No. 6,200,688 discloses high-silicon and high-iron type nickel-base alloys used as material for valve seat inserts. These nickel-base alloys may possibly be used in EGR engines only when the wear rate of the intake valve insert is moderate.

Wear resistant cobalt-base alloys are another type of materials used in the industry, and the most commonly used ones are Stellite® 3 and Trilbaloy® T400 (Tribaloy is a Registered Trademark of Deloro Stellite Holdings Company) for more demanding applications. By way of background in U.S. Pat. Nos. 3,257,178 and 3,410,732, it is believed that Trilbaloy® T400 contains 2.0-2.6 wt % silicon, 7.5-8.5 wt % chromium, 26.5-29.5 wt % molybdenum, up to 0.08 wt % carbon, up to 1.50 wt % nickel, up to 1.5 wt % iron, and the balance being essentially cobalt. It is believed that Stellite® 3 contains 2.3-2.7 wt % carbon, 11.0-14.0 wt % tungsten, 29.0-32.0 wt % chromium, up to 3.0 wt % nickel, up to 3.0 wt % iron, and the balance being cobalt. The above cobalt-base alloys possess both excellent corrosion and wear resistance. However, the cost of these cobalt-base alloys only allows these alloys to be used in limited applications.

Austenitic iron-base valve alloys or valve facing alloys may also be classified into the same group of materials. U.S. Pat. No. 4,122,817 discloses an austenitic iron-base alloy with good wear resistance, PbO corrosion and oxidation resistance. U.S. Pat. No. 4,929,419 discloses a heat, corrosion and wear resistant austenitic steel for internal combustion exhaust valves. However, even in light of all of the above, there is still a need for a corrosion resistant iron-base alloy with good wear resistance, particularly an austenitic iron-base alloy with excellent corrosion resistance to meet the specific demand from more severe corrosion conditions in diesel engines with EGR systems.

BRIEF SUMMARY OF THE INVENTION

A new austenitic iron-base alloy has been invented that possess corrosion resistance close to Stellite® 3 under diluted hot sulfuric acid conditions in a high temperature cyclic corrosion test.

This alloy also possesses enough wear resistance that it can meet most requirements for EGR equipped engines. The cost of the alloy is significantly lower than cobalt-base alloys, such as Stellite® and Trilbaloy®.

In one aspect, the present invention is an alloy with the following composition:

| Element | wt. % |
|---|---|
| Carbon | About 1.8-3.5 |
| Silicon | About 0.5-4 |
| Chromium | About 12-24 |
| Molybdenum and tungsten combined | About 2-12 |
| Nickel | About 12-25 |
| Niobium and vanadium combined | About 0.05-4 |
| Titanium | About 0-1 |
| Aluminum | About 0.01-0.2 |
| Copper | About 0.05-3 |
| Iron | At least about 40 |

Preferably the alloy will contain at least 50 wt % iron. In another aspect of the invention, metal components are either made of the alloy, such as by casting, or by the powder metallurgy method by forming from a powder and sintering. Furthermore, the alloy can be used to hardface the components as the protective coating by powder or wire methods.

DETAILED DESCRIPTION OF THE INVENTION

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous. All percentages herein are weight percentages unless otherwise specified.

Numerous experiments have been accomplished in order to develop alloys with the desired attributes. Alloys with excellent corrosion resistance under static acid immersion-type tests may perform poorly under cyclic heating corrosion because of different corrosion behaviors at high temperatures and the possible influence of oxidation to the corrosion process. The high temperature cyclic corrosion tester provides a tool to study corrosion behavior with the influence of oxidation under high temperature conditions. According to studies conducted in developing the inventive alloys, a number of alloy elements can affect hardness, corrosion and wear resistance of the alloy. It is preferred to have a minimum hardness of 34 HRC in order to achieve good wear resistance in the inventive austenitic alloy. However, the austenitic alloy can become too brittle when the hardness of the alloy exceeds 54 HRC, due to formation of intermetallic compounds like sigma phase from excessive amount of alloying elements. It is relatively easier to achieve enough corrosion resistance with higher chromium and nickel contents under low carbon content. In stainless steels, like AISI 300 series, carbon content is controlled to a minimum level in order to reduce both chromium content tied with carbon and carbide/matrix boundaries for better corrosion resistance. Unfortunately, valve seat insert alloys almost always have much higher carbon content than corrosion resistant stainless steels because a large volume fraction of alloy carbides is mandatory for higher hardness and better wear resistance in wear-resistant alloys using alloy carbides as primary hard phases, which is contrary to the high corrosion resistance requirement. U.S. Pat. No. 6,866,816 discloses an austenitic alloy using low to medium chromium content and high molybdenum. One sample within the scope of the '816 patent contains about 1.6 wt % carbon to achieve good corrosion resistance and wear resistance. To obtain an even higher corrosion resistance, much higher chromium content is used in the present inventive alloy, along with a higher carbon content, to form more alloy carbides in order to compensate for the reduction of hardness and wear resistance due to higher chromium content. Unlike U.S. Pat. No. 6,866,816, in which high contents of refractory alloy elements, like molybdenum and tungsten, are used for higher corrosion resistance and higher hardness, high refractory alloy element contents can cause a brittleness problem in the present inventive alloys when these refractory alloy elements combine with chromium, silicon and other alloying elements to form harmful intermetallic phases. Other different approaches needed to be tested in order to increase the hardness and wear resistance of the current high-chromium type inventive alloy. Through many experimental tests it has been found that the hardness of the preferred inventive alloy is close to the hardness of the alloy disclosed in U.S. Pat. No. 6,866,816.

EXAMPLES

Chemical compositions of all samples are given in Table 1. These alloy samples were prepared in a 60 pounds industry frequency induction furnace by conventional atmosphere melting process. Corrosion, hardness, wear, hot tear and shrinkage samples were cast into shell molds.

The comparative alloy samples in Table 1 have compositions or properties outside the scope of this invention. There are also three commercial alloys, Stellite® 3, M2, and Silichrome XB, and four samples made according to the teachings of some of the above noted patents, listed in Table 1 as comparative alloys.

Ring samples with 45 mm outer diameter, 32 mm inner diameter and 5 mm thickness were used as hardness samples. The hardness values of all samples were obtained using a Rockwell C hardness tester. These ring samples were also used to examine shrinkage defects and hot tear defects of sample alloys. All inventive sample alloys can make low scrap rate ring castings with 45 mm outer diameter, 32 mm inner diameter and 5 mm thickness.

A high temperature cyclic corrosion tester was built to simulate sulfuric acid corrosion at high temperatures. The new corrosion tester provides a better corrosion measurement method than the traditional static immersion corrosion test, as both oxidation and high temperature are also important factors contributing to the corrosion process in the intake valve insert working environment.

The high temperature cyclic corrosion test rig is composed of a heating coil, an air cylinder, one sample with its holder, a control unit, and an acid solution container. First the air cylinder lifts the sample up into the heating coil to heat the specimen. The sample is held inside the coil for about 22 seconds so that the specimen temperature reaches about 300° F. (149° C.). Then the air cylinder moves the heated sample down into the sulfuric acid solution container, and the cycle continues to repeat, taking about 24 seconds per cycle. All acid solution left on the sample is vaporized when the sample is heated inside the heating coil. Therefore both corrosion and oxidation occur in this process, which is closer to the actual insert corrosion in EGR equipped engines than is the static acid immersion test. Corrosion also occurs when the heated specimen is pushed into the sulfuric acid solution container. The testing time was one hour. The sample dimensions were 6.35 mm in diameter and 31.75 mm in length. About 12.7 mm length of the sample was immersed into the solution. 0.25 vol. %, 0.50 vol. %, and 1.0 vol. % sulfuric acid solutions were used for each sample alloy. A precision balance was used to measure the weight of each sample before and after the test. The precision of the balance was 0.0001 gram. The corrosion weight loss was the weight difference of a sample before and after the corrosion test. The lower the corrosion weight loss, the higher the corrosion resistance of an alloy sample. It is expected that these results will be analogous to actual corrosion tests in engines with EGR. The results of the corrosion tests are reported in Table 2 below. (The results of sample alloy No. 6 are repeated several times throughout the table for ease of comparison.) The composition of alloys of the present invention will produce a corrosion weight loss preferably less than 5.0 mg, 10.0 mg, and 18 mg in 0.25, 0.5, and 1.0 vol. % sulfuric acid solutions in the high temperature cyclic corrosion tester, respectively.

A high temperature pin-on-disk wear tester was used to measure the sliding wear resistance of the alloys. Although the actual wear mechanisms are much more complex than the pin-on-disk wear process, the test measures sliding wear under high temperature conditions, which is the common wear mode in valve seat insert wear. A pin specimen with dimensions of 6.35 mm diameter and approximate 25.4 mm long was made of Eatonite 6 valve alloy. Eatonite 6 was used as the pin alloy because it is a common valve facing alloy. Disks were made of sample alloys, each disk having dimensions of 50.8 mm and 12.5 mm in diameter and thickness respectively. The tests were performed at 500° F. (260° C.) in accordance with ASTM G99-90. The tests were performed on samples after simple heat treatment of the disks at 1200° F. (649° C.) for two hours. Each disk was rotated at a velocity of 0.13 m/s for a total sliding distance of 255 m. The weight loss was measured on the disk samples after each test using a balance with 0.1 mg precision. Preferably the sample will have a wear loss of less than 450 mg when tested under these conditions. Disks of M2 tool steel, Silichrome XB, and Stellite® 3 were also made and tested as reference wear resistant alloys in the wear test. The results of the wear test are provided in Table 3 below.

An X-ray examination test was used to determine casting defects inside sample alloy casting specimens. Eight pieces of ring specimens with the same dimensions as the hardness specimens were selected to check casting defect, such as internal shrinkage and hot tear. The results are reported in Table 4 below. The shrinkage and hot tear tendency was rated from 1 to 5, with 1 being the worst and 5 being the best. A rating of 3 was defined as being acceptable for these two types of defects. The relatively small sample numbers still can provide a good indication to major alloy effects on shrinkage and hot tear tendency.

TABLE 1

Alloy Hardness and Chemical Composition (wt %)

| Sample No. | Alloy Name | C | Si | Cr | W | Mo | Fe | V | Nb | Ni | Al | Cu | Hardness (HRC) |
|---|---|---|---|---|---|---|---|---|---|---|---|---|---|
| 1 | Comparative | 1.2 | 1.0 | 18.0 | 7.0 | — | Bal. | 1.0 | 1.0 | 16.0 | 0.04 | 1.5 | 29.0 |
| 2 | Comparative | 1.4 | 1.0 | 18.0 | 7.0 | — | Bal. | 1.0 | 1.0 | 16.0 | 0.04 | 1.5 | 30.4 |
| 3 | | 1.8 | 1.0 | 18.0 | 7.0 | — | Bal. | 1.0 | 1.0 | 16.0 | 0.04 | 1.5 | 34.7 |
| 4 | | 2.0 | 1.0 | 18.0 | 7.0 | — | Bal. | 1.0 | 1.0 | 16.0 | 0.04 | 1.5 | 36.9 |
| 5 | | 2.2 | 1.0 | 18.0 | 7.0 | — | Bal. | 1.0 | 1.0 | 16.0 | 0.04 | 1.5 | 39.9 |
| 6 | | 2.5 | 1.0 | 18.0 | 7.0 | — | Bal. | 1.0 | 1.0 | 16.0 | 0.04 | 1.5 | 41.1 |
| 7 | | 2.7 | 1.0 | 18.0 | 7.0 | — | Bal. | 1.0 | 1.0 | 16.0 | 0.04 | 1.5 | 41.5 |
| 7A | | 3.0 | 1.0 | 18.0 | 7.0 | — | Bal. | 1.0 | 1.0 | 16.0 | 0.04 | 1.5 | 43.7 |
| 7B | | 3.2 | 1.0 | 18.0 | 7.0 | — | Bal. | 1.0 | 1.0 | 16.0 | 0.04 | 1.5 | 46.1 |
| 8 | Comparative | 2.5 | 1.0 | 10.0 | 7.0 | — | Bal. | 1.0 | 1.0 | 16.0 | 0.04 | 1.5 | 45.3 |
| 9 | | 2.5 | 1.0 | 12.0 | 7.0 | — | Bal. | 1.0 | 1.0 | 16.0 | 0.04 | 1.5 | 45.3 |
| 10 | | 2.5 | 1.0 | 13.0 | 7.0 | — | Bal. | 1.0 | 1.0 | 16.0 | 0.04 | 1.5 | 45.6 |
| 11 | | 2.5 | 1.0 | 15.0 | 7.0 | — | Bal. | 1.0 | 1.0 | 16.0 | 0.04 | 1.5 | 44.8 |
| 12 | | 2.5 | 1.0 | 17.0 | 7.0 | — | Bal. | 1.0 | 1.0 | 16.0 | 0.04 | 1.5 | 43.0 |
| 13 | | 2.5 | 1.0 | 20.0 | 7.0 | — | Bal. | 1.0 | 1.0 | 16.0 | 0.04 | 1.5 | 38.3 |
| 14 | | 2.5 | 1.0 | 22.0 | 7.0 | — | Bal. | 1.0 | 1.0 | 16.0 | 0.04 | 1.5 | 38.1 |
| 15 | Comparative | 2.5 | 1.0 | 25.0 | 7.0 | — | Bal. | 1.0 | 1.0 | 16.0 | 0.04 | 1.5 | 39.0 |
| 16 | | 2.5 | 1.0 | 18.0 | 2.0 | — | Bal. | 1.0 | 1.0 | 16.0 | 0.04 | 1.5 | 41.6 |
| 17 | | 2.5 | 1.0 | 18.0 | 4.0 | — | Bal. | 1.0 | 1.0 | 16.0 | 0.04 | 1.5 | 41.0 |
| 18 | Comparative | 2.5 | 1.5 | 18.0 | 7.0 | 7.0 | Bal. | 1.0 | 1.0 | 25.0 | 0.04 | 1.5 | 40.2 |
| 19 | | 2.5 | 1.0 | 18.0 | — | 5.0 | Bal. | 1.0 | 1.0 | 16.0 | 0.04 | 1.5 | 41.1 |
| 20 | Comparative | 2.5 | 2.0 | 18.0 | — | 15.0 | Bal. | 2.0 | 1.0 | 16.0 | 0.04 | 1.5 | 51.0 |
| 21 | | 2.5 | 1.0 | 18.0 | 7.0 | — | Bal. | 1.0 | 1.0 | 12.0 | 0.04 | 1.5 | 41.8 |
| 22 | | 2.5 | 1.0 | 18.0 | 7.0 | — | Bal. | 1.0 | 1.0 | 20.0 | 0.04 | 1.5 | 38.9 |
| 23 | | 2.5 | 1.0 | 18.0 | 7.0 | — | Bal. | 1.0 | 1.0 | 25.0 | 0.04 | 1.5 | 38.6 |
| 24 | | 2.2 | 1.0 | 18.0 | 7.0 | — | Bal. | 3.0 | 1.0 | 16.0 | 0.04 | 1.5 | 38.5 |
| 24A | | 2.5 | 2.0 | 18.0 | 7.0 | | Bal. | 1.0 | 1.0 | 16.0 | 0.04 | 1.5 | 39.0 |
| 25 | | 2.5 | 3.0 | 18.0 | 7.0 | — | Bal. | 1.0 | 1.0 | 16.0 | 0.04 | 1.5 | 36.1 |
| 25A | | 2.5 | 4.0 | 18.0 | 7.0 | — | Bal. | 1.0 | 1.0 | 16.0 | 0.04 | 1.5 | 44.4 |
| 26 | Stellite 3 | 2.4 | — | 30.0 | 12.8 | | 2.0 | — | Co: 50.8 | 2.0 | — | — | 55.0 |
| 27 | M2 | 1.6 | 1.3 | 4.0 | 5.5 | 6.5 | Bal. | 1.5 | — | — | — | — | 42.0 |
| 28 | Tribaloy T400 | 0.08 | 2.6 | 8.5 | — | 28.5 | — | — | Co: 60.4 | — | — | — | 54.2 |
| 28A | Silichrome XB | 1.5 | 2.4 | 20.0 | 0.2 | — | Bal. | — | — | 1.2 | — | — | 40.0 |
| 29 | US6866816 | 1.6 | 2.0 | 9.0 | — | 15.0 | Bal. | — | 2.0 | 16.0 | 0.30 | 1.0 | 43.2 |
| 30 | US6916444 | 2.4 | 1.5 | 6.0 | — | 15.0 | Bal. | 2.5 | 1.5 | 10.0 | — | — | 46.6 |
| 31 | US6436338 | 1.3 | 0.6 | 13.2 | 4.0 | 5.8 | Bal. | 1.3 | 2.1 | 0.6 | — | Co: 2.1 | 45.0 |
| 32 | US4122817 | 1.7 | 0.5 | 24.0 | Mn: 1.4 | 3.9 | Bal. | — | — | 9.2 | — | — | 38.2 |

TABLE 2

Corrosion Test Results (Weight Loss; mg)

| Sample No. | Alloy Name | Element of interest | 0.25 vol % (Sulfuric Acid) | 0.50 vol % (Sulfuric Acid) | 1.00 vol % (Sulfuric Acid) |
|---|---|---|---|---|---|
| 1 | comparative | C: 1.2 wt % | 2.5 | 4.6 | 13.3 |
| 2 | comparative | C: 1.4 Wt % | 3.1 | 4.6 | 14.5 |
| 3 | | C: 1.8 wt % | 2.6 | 7.1 | 13.4 |
| 4 | | C: 2.0 wt % | 4.1 | 7.6 | 14.5 |
| 5 | | C: 2.2 wt % | 3.8 | 8.1 | 15.2 |
| 6 | | C: 2.5 wt % | 3.8 | 8.1 | 14.0 |
| 7 | | C: 2.7 wt % | 4.3 | 8.7 | 14.0 |
| 7A | | C: 3.0 wt % | 2.6 | 7.5 | 16.1 |
| 7B | | C: 3.2 wt % | 1.5 | 8.7 | 12.9 |
| 8 | comparative | Cr: 10.0 wt % | 6.3 | 9.8 | 12.4 |
| 9 | | Cr: 12.0 wt % | 3.7 | 9.5 | 14.4 |

TABLE 2-continued

Corrosion Test Results (Weight Loss; mg)

| Sample No. | Alloy Name | Element of interest | 0.25 vol % (Sulfuric Acid) | 0.50 vol % (Sulfuric Acid) | 1.00 vol % (Sulfuric Acid) |
|---|---|---|---|---|---|
| 10 | | Cr: 13.0 wt % | 2.3 | 9.0 | 17.4 |
| 11 | | Cr: 15.0 wt % | 2.6 | 7.1 | 13.9 |
| 12 | | Cr: 17.0 wt % | 2.7 | 7.8 | 14.8 |
| 6 | | Cr: 18.0 wt % | 3.8 | 8.1 | 14.0 |
| 13 | | Cr: 20.0 wt % | 3.5 | 9.0 | 15.2 |
| 14 | | Cr: 22.0 wt % | 4.2 | 8.9 | 13.5 |
| 15 | comparative | Cr: 25.0 wt % | 2.9 | 5.8 | 11.8 |
| 16 | | W: 2.0 wt % | 3.7 | 7.8 | 13.9 |
| 17 | | W: 4.0 wt % | 3.0 | 5.0 | 15.0 |
| 6 | | W: 7.0 wt % | 3.8 | 8.1 | 14.0 |
| 18 | Comparative | (Mo: 7.0 wt %/W: 7.0 wt % | 2.9 | 4.9 | 11.2 |
| 19 | | Mo: 5.0 wt % | 3.3 | 8.1 | 17.8 |
| 20 | Comparative | Mo: 15.0 wt % | 3.9 | 7.7 | 13.8 |
| 21 | | Ni: 12.0 wt % | 4.1 | 7.8 | 17.9 |
| 6 | | Ni: 16.0 wt % | 3.8 | 8.1 | 14.0 |
| 22 | | Ni: 20.0 wt % | 2.5 | 7.3 | 13.0 |
| 23 | | Ni: 25.0 wt % | 1.1 | 5.5 | 10.7 |
| 24 | | V: 3.0 wt % | 2.7 | 7.8 | 15.1 |
| 6 | | Si: 1.0 wt % | 3.8 | 8.1 | 14.0 |
| 24A | | Si: 2.0 wt % | 3.6 | 6.5 | 13.3 |
| 25 | | Si: 3.0 wt % | 1.8 | 4.0 | 10.6 |
| 25A | | Si: 4.0 wt % | 2.3 | 5.4 | 8.8 |
| 26 | Stellite 3 | | 2.6 | 5.8 | 7.5 |
| 27 | M2 | | 23.5 | 45.0 | 84.1 |
| 28 | Tribaloy T400 | | 1.2 | 4.7 | 11.9 |
| 28A | Silichrome XB | | 19.3 | 42.2 | 67.3 |
| 29 | US6866816 | | 5.2 | 10.3 | 15.0 |
| 30 | US6916444 | | 15.2 | 18.7 | 20.2 |
| 31 | US6436338 | | 13.9 | 19.4 | 33.4 |
| 32 | US4122817 | | 8.7 | 14.4 | 23.6 |

TABLE 3

Wear Test Results

| Sample No. | Alloy Name | Element of interest | Disk Weight Loss (mg) |
|---|---|---|---|
| 1 | Comparative | C: 1.2 wt % | 560.1 |
| 2 | Comparative | C: 1.4 wt % | 481.6 |
| 3 | | C: 1.8 wt % | 407.6 |
| 4 | | C: 2.0 wt % | 393.2 |
| 5 | | C: 2.2 wt % | 348.9 |
| 6 | | C: 2.5 wt % | 345.9 |
| 7 | | C: 2.7 wt % | 283.4 |
| 7A | | C: 3.0 wt % | 119.8 |
| 7B | | C: 3.2 wt % | 44.5 |
| 8 | Comparative | Cr: 10.0 wt % | 149.0 |
| 11 | | Cr: 15.0 wt % | 289.3 |
| 14 | | Cr: 22.0 wt % | 445.1 |
| 15 | Comparative | Cr: 25.0 wt % | 576.2 |
| 16 | | W: 2.0 wt % | 289.3 |
| 18 | Comparative | (Mo: 7.0 wt %/W: 7.0 wt % | 642.7 |
| 19 | | Mo: 5.0 wt % | 432.5 |
| 20 | Comparative | Mo: 15.0 wt % | 555.9 |
| 24 | | V: 3.0 wt % | 423.6 |
| 24A | | Si: 2.0 wt % | 406.5 |
| 25 | | Si: 3.0 wt % | 264.7 |
| 25A | | Si: 4.0 wt % | 77.8 |
| 26 | Stellite 3 | | 41.9 |
| 27 | M2 | | 132.8 |
| 28A | Silichrome XB | | 302.1 |

TABLE 4

Shrinkage and Hot Tear Test Results

| Sample No. | Alloy Name | | Shrinkage Rating | Hot Tear Rating |
|---|---|---|---|---|
| 1 | Comparative | C: 1.2 wt % | 3 | 1 |
| 2 | Comparative | C: 1.4 wt % | 3 | 1 |
| 3 | | C: 1.8 wt % | 3 | 4 |
| 4 | | C: 2.0 wt % | 4 | 5 |
| 5 | | C: 2.2 wt % | 4 | 5 |
| 6 | | C: 2.5 wt % | 4 | 4 |
| 7 | | C: 2.7 wt % | 4 | 5 |
| 7A | | C: 3.0 wt % | 3 | 4 |
| 7B | | C: 3.2 wt % | 3 | 4 |
| 8 | Comparative | Cr: 10.0 wt % | 3 | 5 |
| 9 | | Cr: 12.0 wt % | 4 | 3 |
| 12 | | Cr: 17.0 wt % | 4 | 5 |
| 13 | | Cr: 20.0 wt % | 3 | 5 |
| 14 | | Cr: 22.0 wt % | 4 | 5 |
| 16 | | W: 2.0 wt % | 5 | 5 |
| 17 | | W: 4.0 wt % | 3 | 4 |
| 19 | | Mo: 5.0 wt % | 3 | 5 |
| 21 | | Ni: 12.0 wt % | 4 | 4 |
| 23 | | Ni: 25.0 wt % | 3 | 5 |
| 24 | | V: 3.0 wt % | 5 | 5 |
| 24A | | Si: 3.0 wt % | 3 | 5 |

Samples 1-7, 7A and 7B contain carbon contents from 1.2 to 3.2 wt % with silicon 1.0 wt %, chromium 18.0 wt %, tungsten 7.0 wt %, nickel 16.0 wt %, vanadium 1.0 wt %, niobium 1.0 wt %, aluminum 0.04 wt %, copper 1.5 wt %, and the balance is iron with other impurities associated with casting raw materials. Wear test results indicate that wear resistance increases with carbon content from 1.2 to 3.2 wt %. Hardness change in these sample alloys follows the same trend as wear resistance. Higher carbon containing sample alloys have better wear resistance than M2 tool and Silichrome XB.

Carbon content in the inventive alloy needs to be at least 1.8 or higher in order to achieve enough wear resistance because the hardness of sample alloys with 1.2 and 1.4 wt % carbon is only 29.0 and 30.4 HRC, respectively, and the weight loss of these two comparative sample alloys is 560.1 mg and 481.6 mg, respectively. Corrosion resistance of different carbon content containing sample alloys seems to remain fairly constant and also meets the corrosion resistance requirement. Low carbon content comparative sample alloys 1 and 2 have better corrosion resistance at the low sulfuric acid concentration. However, these low carbon comparative sample alloys do not have enough wear resistance. Further, as seen from the data in Table 4, the shrinkage defect in comparative sample alloys 1 and 2 is acceptable, but the hot tear defect rating in these two low carbon sample alloys is unacceptable. On the other hand, when carbon content of the alloy is at 3.0 wt % and 3.2 wt %, the hot tear rating is acceptable. Therefore, the carbon content needs to be within the range of from about 1.8 to about 3.5%, preferably about 2 to about 3 wt %, more preferably about 2.3 to about 2.7 wt %, for good wear resistance and casting properties.

Samples 8-14 contain chromium from 10.0 to 22.0 wt % with carbon 2.5 wt %, silicon 1.0 wt %, tungsten 7.0 wt %, nickel 16.0 wt %, vanadium 1.0 wt %, niobium 1.0 wt %, aluminum 0.04 wt %, copper 1.5 wt %, and the balance is iron with other impurities associated with casting raw materials. These samples, having different chromium contents, illustrate the effects of chromium on corrosion, hardness and wear resistance. Lower chromium containing alloys generally give lower corrosion resistance, while alloys with higher chromium contents have lower hardness and lower wear resistance. Therefore the chromium content in the inventive alloy needs to be within the range of from about 12 to about 24 wt %, preferably about 14 to about 22 wt %, more preferably about 16 to about 20 wt %, for the balance of good corrosion resistance and adequate wear resistance. While comparative sample 15 has adequate hardness, it has too high of a wear rate.

Samples 6 and 16-20 contain tungsten and/or molybdenum from 2.0 to 15.0 wt % with carbon 2.5 wt %, silicon 1.0-2.0 wt %, chromium 18.0 wt %, nickel 16.0-25.0 wt %, vanadium 1.0-2.0 wt %, niobium 1.0 wt %, aluminum 0.04 wt %, copper 1.5 wt %, and the balance is iron with other impurities associated with casting raw materials. Increasing tungsten and molybdenum have little effect in hardness and corrosion in the range tested. In fact, a higher amount of molybdenum or tungsten causes a decrease in wear resistance. It is not necessary to use high molybdenum and/or tungsten content for better corrosion or higher hardness in the inventive alloy. Addition of molybdenum or tungsten improves hot hardness of the inventive alloy, which is important for the planned application. Intake insert working temperature can reach 700° F. (371° C.). The combined molybdenum and tungsten content needs to be within the range of from about 2 and about 12 wt %, preferably about 2.5 to about 10 wt %, more about preferably about 3 to about 7 wt %. Excessive amount of tungsten or molybdenum reduces wear resistance (see comparative samples No. 18 and 20) and also causes a brittleness problem for castings made from the inventive alloy.

Samples 6, 21, 22 and 23 contain nickel from 12.0 to 25.0 wt % with carbon 2.5 wt %, silicon 1.0 wt %, chromium 18.0 wt %, tungsten 7.0 wt %, vanadium 1.0 wt %, niobium 1.0 wt %, aluminum 0.04 wt %, copper 1.5 wt %, and the balance is iron with other impurities associated with casting raw materials. Nickel has a positive contribution to the corrosion resistance of the alloy. First, there is a minimum amount of nickel required in order to form stable austenite in the alloy. Second, higher nickel content generally improves corrosion resistance of the alloy in all acid concentrations tested. However the improvement is at the expense of lower hardness and lower wear resistance. Therefore, the nickel content needs to be within the range of about 12 to about 25 wt %, preferably about 13 to about 20 wt %, more preferably about 14 to about 18 wt %.

Samples 5 and 24 contain vanadium from 1.0 to 3.0 wt % with carbon 2.2 wt %, silicon 1.0 wt %, chromium 18.0 wt %, tungsten 7.0 wt %, niobium 1.0 wt %, aluminum 0.04 wt %, copper 1.5 wt %, and the balance is iron with other impurities associated with casting raw materials. Vanadium and niobium are strong MC carbide type forming alloy elements. A small addition of vanadium and niobium helps to improve corrosion resistance of the alloy in low acid concentrations. A higher amount of vanadium addition is also beneficial to lower down shrinkage and hot tear defects. However, too much vanadium or niobium decreases the hardness and wear resistance of the alloy. From the corrosion, wear, shrinkage and hot tear test results, vanadium content should be in the within the range of from about 0.02 to about 3 wt %. Similarly, niobium content within the range of from about 0.02 to about 3 wt %. The combined vanadium and niobium content should be between about 0.05 and about 4 wt %, preferably about 1 to about 3.5 wt %, more preferably between about 1.5 and about 2.5 wt %.

Samples 6 and 24A, 25 and 25A contain silicon from 1.0 to 4.0 wt % with carbon 2.5 wt %, chromium 18.0 wt %, tungsten 7.0 wt %, nickel 16.0 wt %, vanadium 1.0 wt %, niobium 1.0 wt %, aluminum 0.04 wt %, copper 1.5 wt %, and the balance is iron with other impurities associated with casting raw materials. Silicon has deoxidizing and desulfurizing effects during alloy melting process. Silicon also has the effect of improving fluidity. However, the main reasons for using silicon in the inventive alloy are that silicon can also improve corrosion and wear resistance of the alloys. Increasing silicon content from 1.0 to 4.0 wt % improves corrosion resistance of the inventive alloy. If the Si content is less than 0.5%, the effects on wear and corrosion are not achieved. If the Si content is more than 4.0 wt %, especially in the high-carbon austenitic alloy, the excessive amount of silicon makes the alloy too brittle. A higher amount of silicon also decreases the hardness of the inventive alloy. Therefore, the silicon content needs to be within the range of from about 0.5 to about 4 wt %, preferably about 0.5 to about 2.5 wt %, and more preferably about 0.5 to about 1.5 wt %.

Addition of copper enhances the corrosion resistance of the alloy significantly. However excessive amount of copper decreases wear resistance of the alloy. Therefore, the range of copper in the alloy needs to be within the range of from about 0.05 to about 3 wt %, preferably about 0.5 to about 2.5 wt %, more preferably about 1 to about 2 wt %.

Manganese also has deoxidizing and desulfurizing effects to molten metals. However, manganese can deteriorate corrosion resistance if its content is too high. Therefore, the manganese range needs to be less than about 1.5 wt %, preferably less than about 1%, more preferably within the range of from about 0.2 to about 0.6 wt %.

A small amount of aluminum, and optionally titanium, is added in the inventive alloys for degassing and precipitation hardening purposes. The amount of aluminum is within the range of from about 0.01 and about 0.2 wt %, preferably between about 0.02 and about 0.1 wt %, and more preferably between about 0.03 and 0.06 wt %. The range for titanium is between about zero and about 1 wt %, preferably between about 0.01 wt % and about 0.5 wt %, more preferably about 0.02 and about 0.06 wt %. When these elements are added, and the alloys heat treated, wear resistance will be improved.

Corrosion and hardness test results for M2 tool steel, Stellite® 3, Tribaloy® T400, Silichrome XB and alloys within the ranges specified in U.S. Pat. No. 6,866,816, U.S. Pat. No. 6,916,444; U.S. Pat. No. 6,436,338; and U.S. Pat. No. 4,122,817, are also given in Table 1 and Table 2. It is clear that many inventive samples have much better corrosion and wear resistance than M2 tool steel and Silichrome XB. Some samples are even close to cobalt-base alloys Stellite® 3 and Trilbaloy® T400 in terms of corrosion resistance. However, these samples are much less expensive than those cobalt-base alloys.

It should be appreciated that the alloys of the present invention are capable of being incorporated in the form of a variety of embodiments, only a few of which have been illustrated and described. The invention may be embodied in other forms without departing from its spirit or essential characteristics. It should be appreciated that the addition of some other ingredients, process steps, materials or components not specifically included will have an adverse impact on the present invention. The best mode of the invention may, therefore, exclude ingredients, process steps, materials or components other than those listed above for inclusion or use in the invention. However, the described embodiments are considered in all respects only as illustrative and not restrictive, and the scope of the invention is, therefore, indicated by the appended claims rather than by the foregoing description. All changes that come within the meaning and range of equivalency of the claims are to be embraced within their scope.

What is claimed is:

1. A homogeneous austenitic iron-base alloy with good corrosion and wear resistance, comprising:

a) about 1.8 to about 3.5 wt % carbon;

b) about 12 to about 24 wt % chromium;

c) about 0.5 to about 4 wt % silicon;

d) about 12 to about 25 wt % nickel;

e) about 2 to about 16 wt % of tungsten and molybdenum combined;

f) about 0.05 to about 4 wt % niobium and vanadium combined;

g) about 0 to about 1 wt % titanium;

h) about 0.01 to about 0.2 wt % aluminum;

i) about 0.05 to about 3 wt % copper;

j) less than about 1.5 wt % manganese; and g) at least 40% iron;

wherein the alloy has a matrix that is essentially all austenite at room temperature and which is stable;

wherein the alloy has a corrosion loss of less than 5 mg when about 12.7 mm of a cylindrical sample of the alloy having a diameter of 6.35 mm and a length of 31.75 mm and heated to about 300° F. (149° C.) is immersed in a 0.25 volume % solution of sulfuric acid at room temperature, withdrawn, heated again, and the cycle repeated for 1 hour, each cycle taking about 24 seconds; and wherein the alloy has a high temperature, pin-on-disc sliding wear resistance, measured using ASTM G99-90 at 500° F. (260° C.), with pin dimensions of 6.35 mm diameter and 25.4 mm length of Eatonite 6 valve facing alloy and a disk of the tested alloy having dimensions of 50.8 mm diameter and 12.5 mm thickness and after simple heat treatment of the disks at 1200° F. (649° C.) for two hours, at 0.13 m/s for 255 m, of less than 450 milligrams.

2. A part for an internal combustion engine comprising the alloy of claim 1.

3. The part of claim 2 where the part is formed by casting the alloy, or hardfacing with the alloy either in wire or powder form.

4. The part of claim 2 where the part is formed by a powder sintering metallurgy method.

5. The alloy of claim 1 wherein the amount of carbon is between about 2.3 and about 2.7 wt %.

6. The alloy of claim 1 wherein the amount of chromium is between about 16 and about 20 wt %.

7. The alloy of claim 1 wherein the amount of silicon is between about 0.5 and about 1.5 wt %.

8. The alloy of claim 1 wherein the amount of tungsten and molybdenum combined is between about 3 and about 7 wt %.

9. The alloy of claim 1 wherein the amount of nickel is between about 14 and about 18 wt %.

10. The alloy of claim 1 wherein the amount of niobium and vanadium combined is between about 1.5 and about 2.5 wt %.

11. The alloy of claim 1 wherein the amount of titanium is between about 0.02 and about 0.06 wt %.

12. The alloy of claim 1 wherein the amount of aluminum is between about 0.03 and about 0.06 wt %.

13. The alloy of claim 1 wherein the amount of copper is between about 1 and about 2 wt %.

14. The alloy of claim 1 wherein the amount of manganese is between about 0.2 and about 0.6 wt %.

15. The alloy of claim 1 wherein the amount of iron is greater than about 50 wt %.

16. The alloy of claim 1 wherein the alloy has a hardness at room temperature of between 34 and 54 on a Rockwell C scale.

17. The alloy of claim 1 wherein the amount of vanadium is between about 0.02 and about 3.0 wt %.

18. The alloy of claim 1 wherein the amount of niobium is between about 0.02 and about 3.0 wt %.

19. The alloy of claim 1 wherein the amount of carbon is between about 2.3 and about 3.5 wt %, and the amount of tungsten and molybdenum combined is between about 2.5 and about 10 wt %.

20. The alloy of claim 1 wherein the amount of carbon is between about 2.3 and about 3.5 wt %, and the amount of chromium is between about 14 and about 22 wt %.

* * * * *